US006763830B1

(12) United States Patent
Davis et al.

(10) Patent No.: US 6,763,830 B1
(45) Date of Patent: Jul. 20, 2004

(54) RESPIRATOR WITH HINGED VISOR

(75) Inventors: Brian E. Davis, Westbury (GB); Gary M. Dunn, Bradford-on-Avon (GB); Mark Smithson, Salisbury (GB)

(73) Assignee: Avon Rubber & Plastics, Inc., Cadillac, MI (US)

( * ) Notice: Subject to any disclaimer, the term of this patent is extended or adjusted under 35 U.S.C. 154(b) by 0 days.

(21) Appl. No.: 10/249,460

(22) Filed: Apr. 11, 2003

Related U.S. Application Data

(62) Division of application No. 10/257,801, filed as application No. PCT/US01/12545 on Apr. 17, 2001.
(60) Provisional application No. 60/198,012, filed on Apr. 18, 2000.

(51) Int. Cl.[7] ..... A62B 18/08
(52) U.S. Cl. ..... 128/206.17; 128/201.24; 128/205.27; 128/205.29
(58) Field of Search ..... 128/201.17, 201.24, 128/206.23, 202.27, 205.27, 205.29, 206.11, 206.15, 206.17

(56) References Cited

U.S. PATENT DOCUMENTS

| | | | | |
|---|---|---|---|---|
| 2,737,659 A | | 3/1956 | Glidden | |
| 3,142,459 A | | 7/1964 | Klusewitz et al. | |
| 3,633,575 A | | 1/1972 | Brumfield | |
| 3,895,397 A | * | 7/1975 | Douglas | 2/428 |
| 4,850,346 A | | 7/1989 | Michel et al. | |
| 4,921,512 A | | 5/1990 | Maryyanek et al. | |
| 5,078,132 A | | 1/1992 | Braun et al. | |
| 5,350,620 A | | 9/1994 | Sundet et al. | |
| 5,660,173 A | | 8/1997 | Newton | |
| 5,732,695 A | | 3/1998 | Metzger | |
| 6,176,239 B1 | | 1/2001 | Grove et al. | |
| 6,328,332 B1 | | 12/2001 | Schutz | |

FOREIGN PATENT DOCUMENTS

| | | |
|---|---|---|
| DE | 692 545 | 6/1940 |
| DE | 36 15 664 | 11/1986 |
| EP | 0 310 970 | 4/1989 |
| FR | 1.158.291 | 1/1958 |
| GB | 516268 | 12/1939 |
| GB | 83 36560.5 | 6/1984 |

* cited by examiner

*Primary Examiner*—Glenn K. Dawson
*Assistant Examiner*—Michael Mendoza
(74) *Attorney, Agent, or Firm*—McGarry Bair PC

(57) ABSTRACT

A gas mask has a facepiece defining an interior chamber and an opening spanning a front portion of facepiece. An optical panel visor is mounted in the opening in the front portion of the facepiece. A hinge joins opposite sides of the visor along a vertical line for relative rotational movement of the opposite sides of the optical panel and the facepiece with respect to each other.

24 Claims, 2 Drawing Sheets

RESPIRATOR WITH HINGED VISOR

CROSS REFERENCE TO RELATED APPLICATIONS

This application is a division a of U.S. patent application Ser. No. 10/257,801, filed Oct. 15, 2002, which is incorporated herein by reference in its entirety and claims priority on International Application No. PCT/US01/12545, filed Apr. 17, 2001, which claims the benefit of U.S. Provisional Application Serial Number 60/198,012, filed Apr. 18, 2000.

BACKGROUND OF INVENTION

1. Field of the Invention

The invention relates to respirators. In one of its aspects, the invention relates to a respirator that is foldable along a vertical axis for storage. In another of its aspects, the invention relates to a respirator that has an optical visor that spans a face piece and is foldable about a vertical axis.

2. Description of the Related Art

U.S. Pat. No. 2,737,659, issued Mar. 13, 1956 to Glidden, discloses an optical gas mask with a pair of separate framed lenses that are separated by a longitudinally extending strip of flexible material from the mask for flexing of the mask along a longitudinal line between lenses to adjust the mask to different faces. The rims and flexible material cut down on the field of view for the mask.

SUMMARY OF INVENTION

A gas mask according to the invention comprises a facepiece defining an interior chamber for filtered air and including at least one inhalation opening for passage of filtered air from the atmosphere to the interior chamber and a filtration canister removably mounted to the facepiece and in fluid communication with the at least one inhalation opening for passage of purified atmospheric air to the facepiece interior chamber and an opening spanning a front portion of facepiece. A visor comprising an optical panel is mounted in the opening in the front portion of the facepiece for user visibility through the facepiece. A hinge joins opposite sides of the visor along a vertical line for relative rotational movement of the opposite sides of the optical panel and the facepiece with respect to each other.

In one embodiment, the hinge is integrally formed with the visor. In another embodiment, the hinge is a mechanical hinge. In yet another embodiment, the hinge is formed by welding.

DETAILED DESCRIPTION

Figure 1:
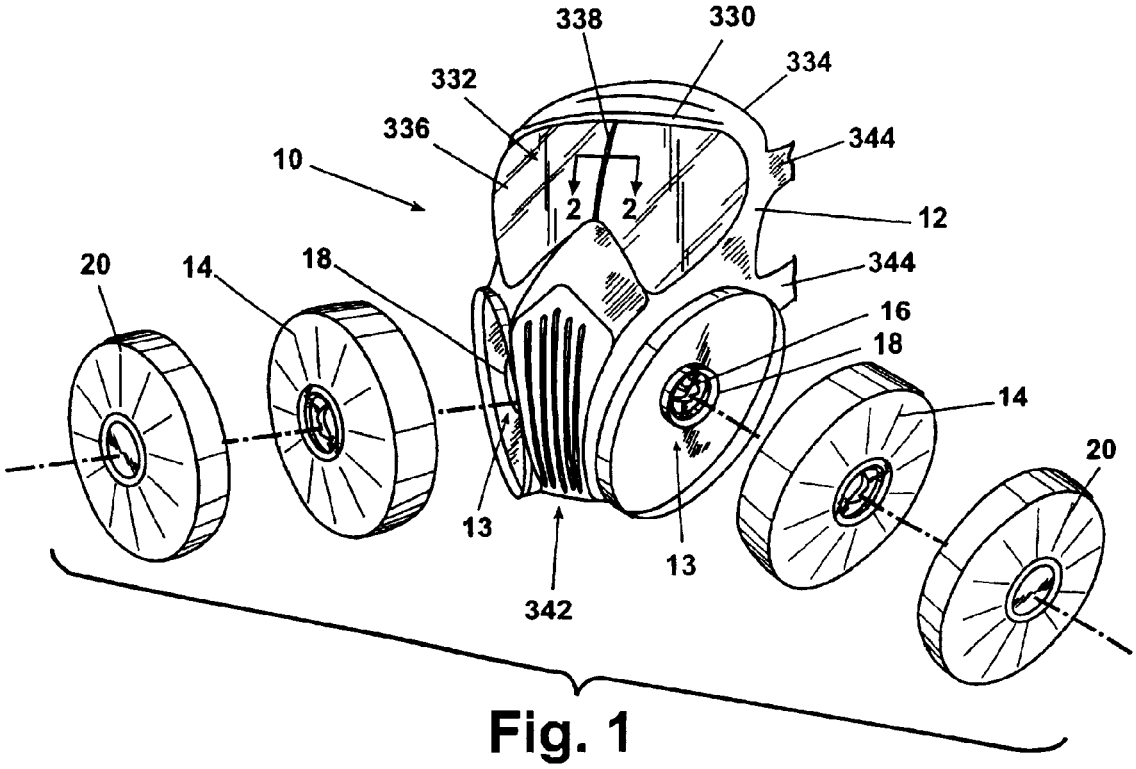
FIG. 1 is an exploded perspective view of a gas mask and filter assembly according to the invention.

A gas mask and filter assembly 10 according to the invention is shown in the drawings, beginning with FIG. 1. The assembly 10 comprises a mask housing 12 that fits onto the users face and defines an interior chamber, and a plurality of filter canisters 14, 20. The housing 12 comprises a pair of circular or elliptical canister mounts 13 including an inlet port assembly and self-sealing mechanism 16 and twist-and-lock connector 18 (shown without detail) for affixing circular or elliptical filter canisters 14 to mask housing 12.

Housing 12 further comprises a facepiece 330 and a visor 332. In a preferred embodiment, facepiece 330 is constructed in multiple sizes of a butyl-rich polymer or other polymer or polymer blend such as butyl/silicone material that will provide the desired level of resistance to penetration of toxic chemicals and will be readily decontaminated.

The facepiece 330 further includes a face seal (not shown) that is also injection molded in a separate co-molding process using a silicone-rich polymer or other polymer or polymer blend that is comfortable for the user and forms an effective seal on the face. In this concept, the outer materials would be selected for chemical agent resistance, decontamination, low set, low flammability, mechanical strength and long-term durability. The seal material would be selected for high level of comfort, low skin toxicity, high flexibility at low temperature and the ability to conform closely to facial features. The materials would have to have an acceptable bond strength. In concept, it would be possible to bond polymer to polymer, polymer to blend, or blend to blend as necessary.

In an alternative embodiment, the facepiece and seal can be constructed of from the same polymer or polymer blend in a single injection molding operation. The face seal is an in-turned periphery 334 of facepiece 330 and including a built-in chin cup (not shown) for correct location on the user's face. In another embodiment, face piece 330 is constructed solely of one type of elastomeric material, such as butyl rubber or a blend of silicone and butyl rubber.

Visor 332 comprises a panel 336, constructed for example of polyurethane and configured to give maximum visibility and flexibility to the user, and providing close eye relief. In the depicted embodiment, the visor 332 further includes an elastomeric central hinge 338, although the visor 332 can be formed without a central hinge. The visor 332 should provide ballistic protection and be configured to receive outserts (not shown) to provide sunlight and laser protection. The visor 332 can further include an anti-scratch surface.

The panel 336 must be acceptable for light transmission, haze and reflectivity and must be resistant to the effects of exposure to chemical contaminants and decontaminants. The panel 336 must also have acceptable performance against impact, and be resistant to other challenges such as scratches or abrasions. In general, optical quality materials such as cast or injection-molded polyurethane or polycarbonate are suitable for the visor panel 336.

The hinge 338 should have adequate tensile strength and should be sufficiently flexible to withstand repeated flexing even at low temperatures (−32° C.). Hinge 338 materials must bond to the panel 336 materials, must not take a set during storage, and should preferably be transparent. Polyurethane, styrene butadiene styrene, styrene ethylene butadiene styrene and some vulcanisit or thermoplastic materials are suitable hinge materials.

Figure 2:
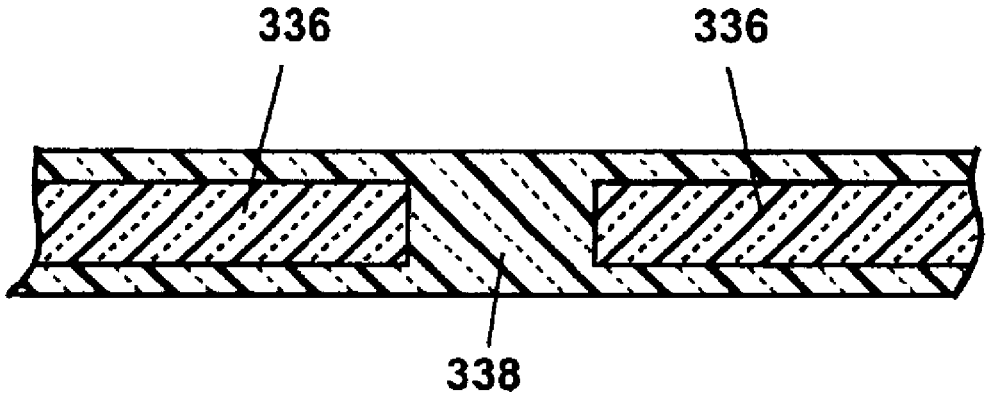
FIG. 2 is a partial cross-sectional view of a visor hinge formed by complete encapsulation and taken along lines 2—2 of FIG. 1.
Figure 3:
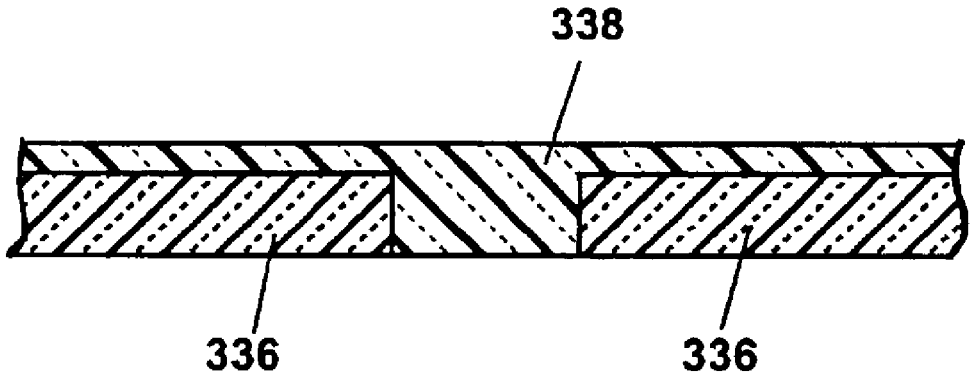
FIG. 3 is a partial cross-sectional view, like FIG. 2 of a visor hinge formed by lamination.

The hinge 338 and panel 336 may be joined together by chemical bonding in a two-part process, or may be adhesively bonded as a post-process operation. The hinge 338 may also be formed as a mechanical hinge, a molded joint, a living hinge or by reduction in the cross-sectional area of the material. The hinge 338 may be formed by complete encapsulation (see FIG. 2) or lamination (see FIG. 3) or the joint between the materials may be made by a form of welding technology using laser, ultrasonic, infra-red or radio frequency (RF) induction.

Housing 12 further comprises a primary speech module 342 that combines the functions of speech, drinking system, and outlet valve assembly. The shape of the primary speech module is acoustically formed to eliminate the need for a speech diaphragm. The inlet and outlet valves are interchangeable, reducing the number of unique spare parts required. Housing 12 is held to a user's face by a plurality of low-profile harness straps 344 defining a flat brow-seal that eliminates hot spots and fits comfortably with a helmet. Harness straps 344 fold over exterior of housing 12 to aid user in rapidly donning mask 10. The interior chamber of housing 12 further comprises a nose cup (not shown) that is formed of a suitable material such as silicone or polyisoprene and is provided in multiple sizes for comfort and fit on different users. The nose cup also acts as an air guide to eliminate misting of the visor 332.

While the invention has been specifically described in connection with certain specific embodiments thereof, it is to be understood that this is by way of illustration and not of limitation. Reasonable variation and modification are possible within the scope of the foregoing description and drawings without departing from the spirit of the invention.

What is claimed is:

1. A gas mask assembly comprising:

a facepicce defining an interior chamber for filtered air and including at least one inhalation opening for passage of filtered air from the atmosphere to the interior chamber;

a filtration canister removably mounted to the facepiece and in fluid communication with the at least one inhalation opening for passage of purified atmospheric air to the facepiece interior chamber;

the facepiece including a single opening with a visor comprising an optical panel spanning the face piece for user visibility through the facepiece; and a hinge joining opposite sides of the visor along a vertical line for relative rotational movement of the opposite sides of the optical panel with respect to each other.

2. A gas mask assembly according to claim 1 wherein the hinge is integrally formed with the visor.

3. A gas mask assembly according to claim 1 wherein the hinge is a mechanical hinge.

4. A gas mask assembly according to claim 1 wherein the hinge is formed by welding.

5. A gas mask assembly according to claim 1 wherein the hinge is formed of an elastomeric material.

6. A gas mask assembly according to claim 1 wherein the hinge is a living hinge formed by a reduction of cross-sectional area of the optical panel material.

7. A gas mask assembly according to claim 1 wherein the hinge is formed by chemical bonding.

8. A gas mask assembly according to claim 1 wherein the hinge is formed by adhesive bonding.

9. A gas mask assembly according to claim 1 wherein the hinge is a molded joint.

10. A gas mask assembly according to claim 1 wherein the hinge is formed by encapsulation of the joint between the opposite sides of the visor.

11. A gas mask assembly according to claim 1 wherein the hinge is formed by lamination of a joint material to the opposite sides of the visor.

12. A gas mask assembly according to claim 1 wherein the hinge is at least partially transparent.

13. A gas mask assembly comprising:

a facepiece defining an interior chamber for filtered air and including at least one inhalation opening for passage of filtered air from the atmosphere to the interior chamber;

a filtration canister removably mounted to the facepiece and in fluid communication with the at least one inhalation opening for passage of purified atmospheric air to the facepiece interior chamber;

the facepiece having a single visor opening spanning a front portion of the face piece with a unitary optical panel mounted in the visor opening and spanning the front portion of the face piece for user visibility through the optical panel, the optical panel having a generally vertical axis separating the optical panel into opposite sides; and a hinge directly joining the opposite sides of the optical panel along the generally vertical axis for relative rotational movement of the opposite sides of the optical panel with respect to each other about the generally vertical axis.

14. A gas mask assembly according to claim 13 wherein the hinge is integrally formed with the visor.

15. A gas mask assembly according to claim 13 wherein the hinge is a mechanical hinge.

16. A gas mask assembly according to claim 13 wherein the hinge is formed by welding.

17. A gas mask assembly according to claim 13 wherein the hinge is formed of an elastomeric material.

18. A gas mask assembly according to claim 13 wherein the hinge is a living hinge formed by a reduction of cross-sectional area of the optical panel material.

19. A gas mask assembly according to claim 13 wherein the hinge is formed by chemical bonding.

20. A gas mask assembly according to claim 13 wherein the hinge is formed by adhesive bonding.

21. A gas mask assembly according to claim 13 wherein the hinge is a molded joint.

22. A gas mask assembly according to claim 13 wherein the hinge is formed by encapsulation of the joint between the opposite sides of the visor.

23. A gas mask assembly according to claim 13 wherein the hinge is formed by lamination of a joint material to the opposite sides of the visor.

24. A gas mask assembly according to claim 13 wherein the hinge is at least partially transparent.

* * * * *